US009915006B2

(12) United States Patent
Hiramatsu

(10) Patent No.: US 9,915,006 B2
(45) Date of Patent: Mar. 13, 2018

(54) REACTIVE-TYPE CHEMICAL CONVERSION TREATMENT COMPOSITION AND PRODUCTION METHOD OF MEMBER WITH CHEMICAL CONVERSION COATED SURFACE

(71) Applicant: YUKEN INDUSTRY CO., LTD., Aichi (JP)

(72) Inventor: Yoshiki Hiramatsu, Aichi (JP)

(73) Assignee: YUKEN INDUSTRY CO., LTD., Aichi (JP)

( * ) Notice: Subject to any disclaimer, the term of this patent is extended or adjusted under 35 U.S.C. 154(b) by 307 days.

(21) Appl. No.: 14/797,035

(22) Filed: Jul. 10, 2015

(65) Prior Publication Data

US 2017/0009363 A1 Jan. 12, 2017

(51) Int. Cl.

| | |
|---|---|
| ***C23C 22/30*** | (2006.01) |
| ***C23C 22/46*** | (2006.01) |
| ***C25D 5/48*** | (2006.01) |
| ***C25D 3/22*** | (2006.01) |
| ***C25D 5/50*** | (2006.01) |
| ***C23C 22/40*** | (2006.01) |
| ***C23C 22/53*** | (2006.01) |
| *C23C 22/00* | (2006.01) |

(52) U.S. Cl.
CPC ..... *C25D 5/48* (2013.01); *C23C 22/40* (2013.01); *C23C 22/46* (2013.01); *C23C 22/53* (2013.01); *C25D 3/22* (2013.01); *C25D 5/50* (2013.01); *C23C 2222/10* (2013.01)

(58) Field of Classification Search
CPC ..... C25D 3/06; C25D 5/48; C25D 11/10
See application file for complete search history.

(56) References Cited

U.S. PATENT DOCUMENTS

| | | | |
|---|---|---|---|
| 2005/0109426 | A1 | 5/2005 | Inoue et al. |
| 2005/0194574 | A1 | 9/2005 | Yamamuro et al. |
| 2008/0160328 | A1 | 7/2008 | Jaworowski et al. |
| 2011/0008645 | A1 | 1/2011 | Schneider et al. |
| 2012/0145282 | A1 | 6/2012 | Kodama et al. |
| 2013/0177768 | A1 | 7/2013 | Kruger et al. |

FOREIGN PATENT DOCUMENTS

| | | | |
|---|---|---|---|
| CA | 2810747 | A1 | 3/2012 |
| EP | 2264221 | A1 | 12/2010 |
| JP | 2003-171778 | A | 6/2003 |
| JP | 2003-268562 | A | 9/2003 |
| JP | 2005-281852 | A | 10/2005 |
| JP | 2006-225761 | A | 8/2006 |
| JP | 2006-274321 | A | 10/2006 |
| JP | 2010-196174 | A | 9/2010 |
| WO | 2009/020097 | A1 | 2/2009 |
| WO | 2010/035819 | A1 | 4/2010 |
| WO | 2011/002040 | A1 | 1/2011 |
| WO | 2012/032102 | A1 | 3/2012 |

OTHER PUBLICATIONS

Extended European Search Report issued in EP Application No. 14152315.9, dated Apr. 17, 2014 (7 pages).

*Primary Examiner* — Lois Zheng
(74) *Attorney, Agent, or Firm* — Nakanishi IP Associates, LLC

(57) ABSTRACT

A production method of a member having a surface provided thereon with a chemical conversion coating includes a contacting step and a washing step. The contacting step causes a reactive-type chemical conversion treating acidic composition to contact with a base material having a metal-based surface thereby forming a chemical conversion coating on the metal-based surface of the base material. The washing step washes the base material having been subjected to the contacting step to obtain a member having a surface provided thereon with the chemical conversion coating. The reactive-type chemical conversion treating acidic composition contains a water-soluble trivalent chromium-containing substance, a water-soluble titanium-containing substance, and a carboxylic acid compound. The acidic composition is free from a water-soluble cobalt-containing substance.

9 Claims, No Drawings

REACTIVE-TYPE CHEMICAL CONVERSION TREATMENT COMPOSITION AND PRODUCTION METHOD OF MEMBER WITH CHEMICAL CONVERSION COATED SURFACE

BACKGROUND OF INVENTION

Field of the Invention

The present invention relates to a chemical conversion treatment composition which is substantially free from a water-soluble cobalt-containing substance and which is capable of forming a chemical conversion coating that has enhanced corrosion resistance with consideration for environmental conservation, and a production method of a member having a surface coated with the chemical conversion treatment composition.

Background of Art

In recent years, according to directives with consideration for environment, such as RoHS (Restriction of the Use of Certain Hazardous Substances in Electrical and Electronic Equipment) directive and ELV (End of Life Vehicles) directive, it has been required to regulate the use of harmful substances (such as lead, mercury, cadmium, and hexavalent chromium).

To this end, chromate coatings, which are effective as chemical conversion coatings for anticorrosion of members having metal surfaces, such as zinc-plated members, have been formed through the use of a chemical conversion treatment liquid that contains trivalent chromium rather than the use of a composition for chemical conversion treatment using a chromate salt that contains hexavalent chromium (a composition for chemical conversion treatment is referred to as "chemical conversion treatment liquid", here and hereinafter).

The chemical conversion coating obtained using a conventional hexavalent chromium-containing chemical conversion treatment liquid contains soluble hexavalent chromium in the coating. Therefore, such a coating is a subject of regulations according to the above directives.

To enhance the corrosion resistance, there has been a case where a water-soluble cobalt-containing substance is contained in a chemical conversion treatment liquid that contains trivalent chromium (e.g., Japanese Patent Application Publication No. 2010-196174A).

Cobalt as the metal for a water-soluble cobalt-containing substance is a kind of so-called rare metal, and involves a possibility that it will be difficult to stably be obtained at low cost. In addition, some of stably available ones among compounds that contain cobalt (cobalt chloride, cobalt carbonate, cobalt nitrate and cobalt sulfate) belong to SVHC (Substances of Very High Concern), so that many companies appear to restrict the use of such substances. In this regard, a trivalent chromium-containing chemical conversion treatment liquid may be required to be substantially free from a water-soluble cobalt-containing substance.

In addition, with regard to a chemical conversion coating formed using a chemical conversion treatment liquid, it may not be preferable that a metal-based component contained in the coating excessively dissolves out therefrom during the use, unless the possibility that the metal-based component negatively affects the environment is denied. Therefore, even though a chemical conversion coating has enhanced corrosion resistance, but if the enhanced corrosion resistance results from excessive dissolution of the metal-based component from the chemical conversion coating, then it may not be appropriate for the chemical conversion treatment liquid to contain a water-soluble metal-containing substance that gives the metal-based component, with consideration for the environment.

SUMMARY OF INVENTION

In view of such circumstances, one or more embodiments of the present invention relate to a chemical conversion treatment liquid which contains trivalent chromium, and which is substantially free from a water-soluble cobalt-containing substance and which is capable of forming a chemical conversion coating that has enhanced corrosion resistance with consideration for environmental conservation. Another object of the invention is to provide a production method of a member having a surface coated with the chemical conversion treatment liquid.

As a result of studies for solving the above problems, the present inventors have found the followings. That is, in a chemical conversion treatment liquid that contains trivalent chromium, by containing a water-soluble titanium-containing substance as substitute for the water-soluble cobalt-containing substance and also containing a carboxylic acid compound, a chemical conversion coating can be formed which has enhanced corrosion resistance and reduced dissolving amount of metal.

One or more embodiments of the present invention are summarized as follows:

(1) A reactive-type chemical conversion treating acidic composition containing a water-soluble trivalent chromium-containing substance, a water-soluble titanium-containing substance, and a carboxylic acid compound, the acidic composition being free from a water-soluble cobalt-containing substance.

(2) The reactive-type chemical conversion treating acidic composition according to the above (1), wherein the content of the water-soluble trivalent chromium-containing substance in the composition is 0.01 mol/L or more and 0.15 mol/L or less in terms of chromium, the content of the water-soluble titanium-containing substance in the composition is 0.0001 mol/L or more and 1 mol/L or less in terms of titanium, and the content of the carboxylic acid compound in the composition is 0.001 mol/L or more and 0.2 mol/L or less in terms of carboxylic acid.

(3) The reactive-type chemical conversion treating acidic composition according to the above (1) or (2), further containing at least one acid compound from the group consisting of citric acid compound and oxalic acid compound.

(4) The reactive-type chemical conversion treating acidic composition according to any one of the above (1) to (3), wherein first ratio, which is ratio of the content of citric acid compound in terms of citric acid (unit: mol/L) to the content of water-soluble trivalent chromium-containing substance in terms of chromium (unit: mol/L), is 0.05 or more and 0.8 or less.

(5) The reactive-type chemical conversion treating acidic composition according to the above (4) wherein the first ratio is 0.1 or more and 0.6 or less.

(6) The reactive-type chemical conversion treating acidic composition according to any one of the above (1) to (5), wherein second ratio, which is ratio of the content of oxalic acid compound in terms of oxalic acid (unit: mol/L) to the content of water-soluble trivalent chromium-containing substance in terms of chromium (unit: mol/L), is 0.05 or more and 2 or less.

(7) The reactive-type chemical conversion treating acidic composition according to the above (6) wherein the second ratio is 0.1 or more and 1.7 or less.

(8) The reactive-type chemical conversion treating acidic composition according to the above (1) to (7), wherein the composition is free from water-soluble vanadium-containing substance, water-soluble fluorine-containing substance, or film-forming organic component.

(9) The reactive-type chemical conversion treating acidic composition according to the above (1) to (8), further containing organic phosphoric acid compound of 0.001 mol/L or more and 1 mol/L or less in terms of phosphorus.

(10) The reactive-type chemical conversion treating acidic composition according to the above (9), further containing water-soluble zinc-containing substance of 0.005 mol/L or more and 0.1 mol/L or less in terms of zinc.

(11) The reactive-type chemical conversion treating acidic composition according to any one of the above (1) to (10), further containing water-soluble aluminum-containing substance of 0.0001 mol/L or more and 0.1 mol/L or less in terms of aluminum.

(12) A production method of a member having a surface provided thereon with a chemical conversion coating, the production method including: a contacting step that causes the acidic composition according to any one of the above (1) to (11) to contact with a base material having a metal-based surface thereby forming a chemical conversion coating on the metal-based surface of the base material; and a washing step that washes the base material having been subjected to the contacting step to obtain a member having a surface provided thereon with the chemical conversion coating.

(13) The production method of a member according to the above (12), wherein the metal-based surface is either one surface selected from the group consisting of a surface of the zinc-based plated film formed using a chloride bath, a surface of the plated film obtainable by forming a zinc-based plated film using a zincate bath and subjecting this to baking treatment, and a surface of the zinc-based plated film formed using a zincate bath without baking treatment.

(14) The production method of a member according to the above (13), wherein the metal-based surface is the surface of the plated film obtainable by forming a zinc-based plated film using a zincate bath and subjecting this to baking treatment, and the carboxylic acid compound includes oxalic acid compound.

(15) A member including a base material having a metal-based surface and a chemical conversion coating provided on the metal-based surface, wherein the chemical conversion coating is formed by an application of a reactive-type chemical conversion treating acidic composition containing a water-soluble trivalent chromium-containing substance, a water-soluble titanium-containing substance, and a carboxylic acid compound, the acidic composition being free from a water-soluble cobalt-containing substance.

(16) The member according to the above (15), wherein the metal-based surface is either one surface selected from the group consisting of a surface of the zinc-based plated film formed using a chloride bath, a surface of the plated film obtainable by forming a zinc-based plated film using a zincate bath and subjecting this to baking treatment, and a surface of the zinc-based plated film formed using a zincate bath without baking treatment.

(17) The member according to the above (16), wherein the metal-based surface is the surface of the plated film obtainable by forming a zinc-based plated film using a zincate bath and subjecting this to baking treatment, and the carboxylic acid compound includes oxalic acid compound.

A chemical conversion treatment liquid according to one or more embodiments of the present invention is capable of forming a chemical conversion coating that has enhanced corrosion resistance with consideration for environmental conservation, without using any water-soluble cobalt-containing substance which has conventionally been in heavy usage for forming a chemical conversion coating that has enhanced corrosion resistance. Also, in one or more embodiments of the present invention, a production method of a member having a surface coated with the chemical conversion treatment liquid is provided.

DETAILED DESCRIPTION

Embodiments of the present invention will hereinafter be described in detail.

1. Acidic Composition for Reactive Chemical Conversion Treatment

Descriptions will now be directed to the composition of an acidic composition for reactive chemical conversion treatment according to one embodiment of the present invention (also referred herein to as "chemical conversion treatment liquid).

(1) Water-Soluble Trivalent Chromium-Containing Substance

The chemical conversion treatment liquid according to one embodiment of the present invention contains at least one type of a water-soluble trivalent chromium-containing substance. The water-soluble trivalent chromium-containing substance may be selected from the group consisting of trivalent chromium ($Cr^{3+}$) and a water-soluble substance that contains trivalent chromium.

It is preferred to use a water-soluble compound capable of generating the water-soluble trivalent chromium-containing substance in water (referred hereinafter to as "water-soluble trivalent chromium compound") as a substance to be compounded for containing the water-soluble trivalent chromium-containing substance in the chemical conversion treatment liquid, i.e., a raw material substance for the water-soluble trivalent chromium-containing substance.

Examples of the water-soluble trivalent chromium compound include trivalent chromium salt, such as chromium chloride, chromium sulfate, chromium nitrate, chromium phosphate and chromium acetate, and a compound obtained by reducing a hexavalent chromium compound, such as chromic acid and bichromate, to trivalent using a reductant. The water-soluble trivalent chromium compound may consist only of one type of compound, or may include plural types. It should be appreciated that the chemical conversion treatment liquid according to the present embodiment is substantially free from hexavalent chromium because any hexavalent chromium compound is not added actively as a raw material to the chemical conversion treatment liquid according to the present embodiment.

Preferred content of the water-soluble trivalent chromium-containing substance in the chemical conversion treatment liquid according to the present embodiment is about 0.01 mol/L or more in terms of chromium with consideration for improving formability of the chemical conversion coating, more preferred content thereof is about 0.02 mol/L or more, or most preferred content thereof is about 0.04 mol/L or more. The upper limit of the content may preferably be, but not limited to, about 0.15 mol/L, more preferable be about 0.12 mol/L, or most preferably be about 0.1 mol/L in terms of chromium because unduly large content may possibly lead to problems, such as from the viewpoints of economic efficiency and waste liquid treatment.

(2) Water-Soluble Titanium-Containing Substance

The chemical conversion treatment liquid according to the present embodiment contains at least one type of a water-soluble titanium-containing substance. The water-soluble titanium-containing substance may be selected from the group consisting of titanium ion ($Ti^{3+}$, $Ti^{4+}$) and a water-soluble substance that contains titanium ion.

It is preferred to use a water-soluble compound capable of generating the water-soluble titanium-containing substance in water (referred hereinafter to as "water-soluble titanium compound") as a substance to be compounded for containing the water-soluble titanium-containing substance in the chemical conversion treatment liquid, i.e., a raw material substance for the water-soluble titanium-containing substance.

Examples of the water-soluble titanium compound which can be used include carbonate, oxide, hydroxide, nitrate, sulfate, phosphate, fluoride, fluoro acid (salt), organic acid salt and organic complex compound of Ti. Specific examples include titanium (IV) oxide (titania), titanium nitrate, titanium (III) sulfate, titanium (IV) sulfate, titanyl sulfate $TiOSO_4$, titanium (III) fluoride, titanium (IV) fluoride, hexafluorotitanic acid $H_2TiF_6$, ammonium hexafluorotitanate $[(NH_4)_2TiF_6]$, titanium laurate, diisopropoxy titanium bisacetone $(C_5H_7O_2)_2Ti[OCH(CH_3)_2]_2$, and titanium acetylacetonate $Ti(OC(=CH_2)CH_2COCH_3)_3$. These may be in any form of anhydride or hydrate. It is preferred that the water-soluble titanium compound is free from fluorine because the chemical conversion treatment liquid according to the present embodiment may preferably be a chemical conversion treatment liquid with less environmental burden.

Preferred content of the water-soluble titanium-containing substance in the chemical conversion treatment liquid according to the present embodiment is about 0.0001 mol/L or more in terms of titanium with consideration for improving formability of the chemical conversion coating, more preferred content thereof is about 0.0005 mol/L or more, or most preferred content thereof is about 0.001 mol/L or more. The upper limit of the content may preferably be, but not limited to, about 1 mol/L in terms of titanium, more preferably be about 0.5 mol/L or more, or most preferably be about 0.1 mol/L or more because unduly large content may increase the possibility of deteriorating the stability of the chemical conversion treatment liquid and also increase the possibility of problems, such as from the viewpoints of economic efficiency and waste liquid treatment.

(3) Carboxylic Acid Compound

The chemical conversion treatment liquid according to the present embodiment contains a carboxylic acid compound. The "carboxylic acid compound" as used herein means a compound that includes one or more types selected from the group consisting of a carboxylic acid, which is an organic acid having a carboxylic group, and ions, salts, derivatives and coordination compounds thereof, and is in a state of being dissolved in the chemical conversion treatment liquid as an aqueous composition.

Examples of a carboxylic acid that gives the carboxylic acid compound according to one or more embodiments of the present invention include: monocarboxylic acid, such as formic acid, acetic acid and propionic acid; dicarboxylic acid, such as oxalic acid, malonic acid, succinic acid, glutaric acid, adipic acid, pimelic acid, suberic acid, azelaic acid, sebacic acid, maleic acid, phthalic acid and terephthalic acid; tricarboxylic acid, such as tricarballylic acid and aconitic acid; hydroxy carboxylic acid, such as glycolic acid, lactic acid, malic acid, tartaric acid, citric acid, isocitric acid and ascorbic acid; and aminocarboxylic acid, such as glycine and alanine.

The carboxylic acid compound according to the present embodiment may contain one or more types selected from the group consisting of a citric acid compound and an oxalic acid compound. The "citric acid compound" as used herein means a compound that includes one or more types selected from the group consisting of a citric acid, and ions, salts, derivatives and coordination compounds thereof, and is in a state of being dissolved in the chemical conversion treatment liquid as an aqueous composition. The "oxalic acid compound" as used herein means a compound that includes one or more types selected from the group consisting of an oxalic acid, and ions, salts, derivatives and coordination compounds thereof, and is in a state of being dissolved in the chemical conversion treatment liquid as an aqueous composition.

The carboxylic acid compound contained in the chemical conversion treatment liquid according to the present embodiment may contain either one or both of a citric acid compound and an oxalic acid compound. When the surface to be treated is provided by a zinc-based plated film (which collectively means herein a zinc plated film and zinc alloy plated film) formed using a chloride bath, the carboxylic acid compound contained in the chemical conversion treatment liquid according to the present embodiment may contain at least one acid from a citric acid compound and an oxalic acid compound, or may preferably consist essentially of either one of them. When the surface to be treated is provided by a film obtained by forming a zinc-based plated film using a zincate bath and subjecting this to baking treatment, the carboxylic acid compound contained in the chemical conversion treatment liquid according to the present embodiment may contain oxalic acid compound, or may preferably consist essentially of oxalic acid compound. When the surface to be treated is provided by a film that is a zinc-based plated film formed using a zincate bath but without baking treatment, the carboxylic acid compound contained in the chemical conversion treatment liquid according to the present embodiment may contain at least one from a citric acid compound and an oxalic acid compound, or may preferably consist essentially of either one of them.

It is preferred to use a water-soluble compound capable of generating the carboxylic acid compound in water (referred hereinafter to as "carboxylic acid source") as a substance to be compounded for containing the carboxylic acid compound in the chemical conversion treatment liquid, i.e., a raw material substance for the carboxylic acid compound. Specific examples of the carboxylic acid source include: carboxylic acid derivatives, such as carboxylic ester; carboxylic acid; and carboxylic salt (metal salt). In view of high solubility and improvement of easy interaction between the generated carboxylic acid compound and other components contained in the chemical conversion treatment liquid, the carboxylic acid source may be carboxylic salt. Examples of such carboxylic salt include sodium oxalate, sodium citrate, potassium oxalate, and potassium citrate.

Preferred content of the carboxylic acid compound in the chemical conversion treatment liquid according to the present embodiment is about 0.001 mol/L or more in terms of carboxylic acid with consideration for improving formability of the chemical conversion coating, more preferred content thereof is about 0.004 mol/L or more, or most preferred content thereof is about 0.008 mol/L or more. The upper limit of the content may preferably be, but not limited to, about 0.4 mol/L in terms of carboxylic acid, more preferably about 0.2 mol/L, or most preferably about 0.1 mol/L because unduly large content may increase the possibility of deteriorating the stability of the chemical conversion treatment liquid and also increase the possibility of problems, such as from the viewpoints of economic efficiency and waste liquid treatment.

A ratio (first ratio) of the content of citric acid compound in terms of citric acid (unit: mol/L) of the chemical conversion treatment liquid according to the present embodiment (unit: mol/L) to the content of water-soluble trivalent chromium-containing substance in terms of chromium (unit: mol/L) may preferably be about 0.05 or more and about 0.8 or less, more preferably about 0.1 or more and about 0.6 or less, and most preferably about 0.2 or more and about 0.4 or less, from the viewpoint of easily forming a chemical conversion coating that has enhanced corrosion resistance. A ratio (second ratio) of the content of oxalic acid compound in terms of oxalic acid (unit: mol/L) to the content of the water-soluble trivalent chromium-containing substance in terms of chromium (unit: mol/L) may preferably be about 0.05 or more and about 2 or less, easily forming a chemical conversion coating that has enhanced corrosion resistance from the viewpoint of easily forming a chemical conversion coating that has enhanced corrosion resistance, may more preferably be about 0.1 or more and about 1.7 or less, or may most preferably be about 0.6 or more and about 1.7 or less.

The chemical conversion treatment liquid according to the present embodiment may contain an organic acid compound other than the above carboxylic acid compound. Examples of an organic acid associated with such an organic acid compound include sulfonic acid. The content of such organic acid compounds in the chemical conversion treatment liquid according to the present embodiment may preferably be, but not limited to, within a range where the above carboxylic acid compound can function appropriately.

(4) Organic Phosphonic Acid Compound

The chemical conversion treatment liquid according to the present embodiment may contain an organic phosphonic acid compound. The "organic phosphonic acid compound" as used herein means a compound that includes one or more types selected from the group consisting of an organic phosphonic acid, and ions and salts thereof, while the "organic phosphonic acid" as used herein means one of which the rational formula is $R—P(=O)(OH)_2$ (where R is an organic group) and in which an organic group is bonded to the phosphonic group. Containing an organic phosphonic acid compound can reduce the dissolving amount of metal, in particular the dissolving amount of chromium, from a chemical conversion film that is formed using the chemical conversion treatment liquid.

Examples of the organic phosphonic acid include 1-hydroxyethylidene-1,1-diphosphonic acid, 2-phosphonobutane1,2,4-tricarboxylic acid, amino(trimethylene phosphonic acid), ethylenediamine tetra(methylene phosphonic acid), and diethylene triamine penta(methylene phosphonic acid).

Examples of salts of the organic phosphonic acids include tetrasodium 1-hydroxyethylidene-1,1-diphosphonate, trisodium 1-hydroxyethylidene-1,1-diphosphonate, pentasodium ethylenediamine tetra(methylene phosphonate), and heptasodium diethylene triamine penta(methylene phosphonate). These salts may often be such that sodium ions are dissociated in the chemical conversion treatment liquid.

When the chemical conversion treatment liquid according to the present embodiment contains the organic phosphonic acid compound, preferred content of the organic phosphonic acid compound is about 0.001 mol/L or more in terms of phosphorus in view of making it easy to form the chemical conversion coating having an excellent property, more preferred content thereof is about 0.005 mol/L or more, or most preferred content thereof is about 0.01 mol/L or more. The upper limit of the content may preferably be, but not limited to, about 1 mol/L in terms of phosphorous, or may more preferably be about 0.1 mol/L because unduly large content may increase the possibility of deteriorating the appearance of obtained chemical conversion coating and also increase the possibility of problems, such as from the viewpoints of economic efficiency and waste liquid treatment. It may be possibly preferred that the chemical conversion treatment liquid according to the present embodiment is substantially free from the organic phosphonic acid compound.

(5) Water-Soluble Zinc-Containing Substance

When the chemical conversion treatment liquid according to the present embodiment contains the organic phosphonic acid compound as described above, the chemical conversion treatment liquid according to the present embodiment may further contain at least one type of a water-soluble zinc-containing substance. The water-soluble zinc-containing substance may be selected from the group consisting of zinc ions ($Zn^{2+}$) and a water-soluble substance that contains zinc ions. If, when the chemical conversion treatment liquid according to the present embodiment contains the organic phosphonic acid compound, the water-soluble zinc-containing substance is further contained, then it may be able to enhance the quality stability of the chemical conversion coating formed using the chemical conversion treatment liquid.

It is preferred to use a water-soluble compound capable of generating the water-soluble zinc-containing substance in water (referred hereinafter to as "water-soluble zinc compound") as a substance to be compounded for containing the water-soluble zinc-containing substance in the chemical conversion treatment liquid, i.e., a raw material substance for the water-soluble zinc-containing substance.

Examples of the water-soluble zinc compound include compounds, such as zinc chloride, zinc carbonate, zinc oxide, zinc borate, zinc acetate, zinc sulfate, and zinc nitrate. The water-soluble zinc compound may consist only of one type of compound, or may include plural types.

When the chemical conversion treatment liquid according to the present embodiment contains the water-soluble zinc-containing substance, preferred content of the water-soluble zinc-containing substance is 0.005 mol/L or more in terms of zinc in view of making it easy to form the chemical conversion coating, more preferred content thereof is about 0.01 mol/L or more, or most preferable content thereof is about 0.015 mol/L or more. The upper limit of the content may preferably be, but not limited to, about 0.1 mol/L in terms of zinc, may more preferably be about 0.075 mol/L, or may most preferably be about 0.05 mol/L because unduly large content may increase the possibility of deteriorating the stability of the chemical conversion treatment liquid and also increase the possibility of problems, such as from the viewpoints of economic efficiency and waste liquid treatment.

(6) Other Components

The chemical conversion treatment liquid according to the present embodiment may contain, in addition to the above substances, one or more types selected from the group consisting of a water-soluble metal-containing substance associated with a metal other than the above metals (Cr, Zn and Ti), an inorganic acid and anions thereof, an inorganic colloid, a silane coupling agent, and an organic phosphorous compound. The chemical conversion treatment liquid may further contain: polyphenol, such as pyrogallol and benzenediol; corrosion inhibitor; surfactant, such as diol, triol and amine; plastic dispersant; coloring material, such as dye, pigment, metal pigment generating agent and other pigment generating agents; desiccant; and dispersant.

It should be appreciated that the chemical conversion treatment liquid according to the present embodiment is substantially free from a water-soluble substance including fluorine in view of decreasing environmental impact. Moreover, the chemical conversion treatment using the chemical conversion treatment liquid according to the present embodiment is reactive-type, so that substantially no film-forming organic component is contained therein.

Examples of a metal element that is contained in the water-soluble metal-containing substance associated with a metal other than the above metals (Cr, Zn and Ti) include Ni, Na, K, Ag, Fe, Ca, Mg, Sc, Mn, Cu, Sn, Mo, Al, and W, which may be present in a form of oxygen acid ion, such as tungstate ion, or in a form of coordination compound. Such a water-soluble metal-containing substance may be contained thereby to provide additional advantageous effects. For example, if the water-soluble aluminum-containing substance is contained, then the appearance of obtained chemical conversion coating may be improved, and/or the dependency of the coating properties, such as corrosion resistance and dissolving amount of metal, on the base material may be reduced (specific example of the dependency may be such that the coating properties are likely to vary if the type of bath used to form a zinc-based plating is different).

The content of the water-soluble additive metal compound may not be particularly limited. It may be set in consideration of a role of the metal element contained in each water-soluble additive metal compound. For water-soluble aluminum-containing substance, for example, the content may be about 0.0001 mol/L or more in terms of aluminum, may preferably be about 0.0005 mol/L or more, or may most preferably be about 0.001 mol/L or more. The upper limit of the content may preferably be, but not limited to, about 1 mol/L in terms of aluminum, may more preferably be about 0.5 mol/L, or may most preferably be about 0.1 mol/L because unduly large content may increase the possibility of deteriorating the stability of the chemical conversion treatment liquid and also increase the possibility of problems, such as from the viewpoints of economic efficiency and waste liquid treatment.

It should be appreciated that the chemical conversion treatment liquid according to the present embodiment is substantially free from a water-soluble cobalt-containing substance which involves concerns about affecting the environment. Moreover, the chemical conversion treatment liquid according to the present embodiment is substantially free from a water-soluble vanadium-containing substance because the dissolving amount of V may be unduly large from a chemical conversion coating that contains V, in which case concern is that the dissolved V affects the environment.

Examples of the inorganic acid include hydrohalic acid other than hydrofluoric acid such as hydrochloric acid and hydrobromic acid; chloric acid, perchloric acid, chlorous acid, hypochlorous acid, sulfuric acid, sulfurous acid, nitric acid, nitrous acid, phosphoric acid (orthophosphoric acid), polyphosphoric acid, metaphosphoric acid, pyrophosphoric acid, ultraphosphoric acid, hypophosphorous acid, and superphosphoric acid, among which, one or more of the inorganic acid selected from the group consisting of hydrohalic acid other than hydrofluoric acid, sulfuric acid, nitric acid, and phosphoric acid (orthophosphoric acid) may preferably be contained as anions.

The concentration of these inorganic acids and/or inorganic acid ions in the chemical conversion treatment liquid is not particularly limited. The ratio of the total molar concentration of inorganic acids and inorganic acid ions to the total molar concentration in terms of metal of the water-soluble metal-containing substance may ordinarily be about 0.1 or more and about 10 or less, and preferably about 0.5 or more and about 3 or less.

Examples of the inorganic colloid include silica sol, alumina sol, titanium sol and zirconia sol, and examples of the silane coupling agent include vinyltriethoxysilane and γ-methacryloxypropyltrimethoxysilane.

(7) Solvent and pH

The solvent of the chemical conversion treatment liquid according to the present embodiment contains water as the main component. An organic solvent, such as alcohol, ether and ketone, which has a high solubility in water may be mixed with water as solvent except water. In this case, the ratio thereof may preferably be about 10 vol % or less to the whole solvent in view of the stability in the whole chemical conversion treatment liquid.

From the viewpoint of progressing the chemical conversion treatment, the chemical conversion treatment liquid according to the present embodiment is caused to be acidic, and the pH is therefore less than 7. The preferable value of pH within the acidic range is not particularly limited. The pH may appropriately be set considering that unduly low pH increases the possibility that the formation of the chemical conversion coating will be non-uniform while unduly high pH increases the possibility that the stability of the chemical conversion treatment liquid will deteriorate. In view of improving the quality of the chemical conversion coating and the stability of the chemical conversion treatment liquid, the pH may preferably be about 1 or more and about 5 or less, and more preferably about 1.5 or more and about 3 or less.

2. Concentrated Composition for Preparing Chemical Conversion Treatment Liquid

If a liquid composition having a composition in which major components of the above chemical conversion treatment liquid are concentrated about 5 to about 20 times (referred hereinafter to as "concentrated liquid for chemical conversion treatment") is prepared, then bother of preparing individually the content of each component can be saved and storage thereof may be easy, thus being preferable. When this concentrated liquid for chemical conversion treatment is prepared, upper limits may be provided for the contents of the above respective components with consideration for the solubility of each component.

3. Base Material to be Subjected to Chemical Conversion Treatment

The material quality of a base material to be subjected to the chemical conversion treatment according to the present embodiment is not particularly limited so long as the base material has a metal surface on which the chemical conversion coating can be formed using the chemical conversion treatment liquid according to the present embodiment. Preferable material is a metal-based material, and in particular a steel plate formed thereon with zinc-based plating is most preferable. Method of plating may be electroplating or may also be hot-dip plating, and when hot-dip plating is employed, an alloying process by heat may be performed after the plating.

The composition of the above zinc-based plating may be pure zinc or may also be zinc alloy. When zinc alloy plating is employed, examples of metal to be alloyed include iron, nickel, and aluminum. Method of plating may be electroplating or may also be hot-dip plating. When electroplating is employed, any of cyanide bath, chloride bath, sulfuric acid bath and zincate bath may be used, and a baking treatment may be performed after preparing the plated film. When hot-dip plating is employed, an alloying process may be performed after the plating.

4. Production Method of Member Having Surface Provided Thereon With Chemical Conversion Coating Descriptions will now be directed to a production method for a member having a surface provided thereon with a chemical conversion coating, using the chemical conversion treatment liquid according to the present embodiment.

The production method according to the present embodiment includes: a contacting step that causes the chemical conversion treatment liquid according to the present embodiment to contact with a base material having a metal-based surface thereby forming a chemical conversion coating on the metal-based surface of the base material; and a washing step that washes the base material having been subjected to the contacting step to obtain a member having a surface provided thereon with the chemical conversion coating.

In the contacting step, method of causing the chemical conversion treatment liquid according to the present embodiment to contact with the base material having a metal-based surface is not particularly limited. The simplest method is immersing, but spraying may be employed, or application may also be possible using a roll, etc. The contacting condition (contacting temperature, contacting time) is not particularly limited, and may be set in consideration of the composition of the chemical conversion treatment liquid, the composition of a material that constitutes the base material surface, and the productivity, etc. When the temperature of the chemical conversion treatment liquid ranges from room temperature (about 23° C.) to about 40° C., the contacting time may typically be within a range of about 10 seconds to about 5 minutes. Note that the chemical conversion treatment liquid according to the present embodiment is a reactive chemical conversion treatment liquid, and hence, even if the time duration is set to be unduly long, the thickness of the chemical conversion coating will not increase in general as time goes on.

A base material to be subjected to the contacting step may be washed (e.g., degreasing and rinsing) using a known method, followed by an activation treatment designed such that the base material is contacted (at room temperature (about 23° C.) for about 10 seconds) with an acid aqueous solution (e.g., nitric acid aqueous solution of several ml/L).

The base material having been subjected to the contacting step is washed using water, for example. This feature is different from that for a so-called application-type chemical conversion treatment liquid, and the washing step is a step to be performed due to the reason that the chemical conversion treatment liquid according to the present embodiment is a reactive chemical conversion treatment liquid. Such a step washes away the chemical conversion treatment liquid that remains on the surface of the base material having been subjected to the contacting step, and a member is thus obtained which includes the base material and the chemical conversion coating formed on the surface of the base material. For the member after the washing, a drying step is conducted ordinarily for the purpose of removing the water adhering to the chemical conversion coating and the base material. The drying condition (drying temperature, drying time) is not particularly limited. The drying condition may appropriately be set in consideration of heat resistance of the base material, productivity, and the like. Various cases for drying may be possible, such as a case where the member is stationarily placed for about 10 minutes in an oven maintained at a temperature of about 100° C. or less, a case where a centrifuge separator is used for drying, and a case where the member is stationarily placed in ordinary environment. Depending on the type of chemical conversion coating, the drying may cause a change in the composition, such as a change of a part or whole of the hydroxide into oxide.

The production method according to the present embodiment may include a finishing step that, after the above member has been treated using the chemical conversion treatment liquid according to the present embodiment to form the chemical conversion coating, performs treatment using a finishing agent for enhancing the corrosion resistance and scratch resistance to form a finishing coating. The relationship between the finishing step and the drying step is freely selected such that, after the washing step, the drying step may be performed after the finishing step has been completed, or the finishing step may be performed after the drying step has been completed.

Specific examples of the metal-based surface of the base material being the surface to be treated may include a surface of the zinc-based plated film formed using a chloride bath, a surface of the plated film obtainable by forming a zinc-based plated film using a zincate bath and subjecting this to baking treatment, and a surface of the zinc-based plated film formed using a zincate bath without baking treatment. When the surface to be treated is the surface of the zinc-based plated film formed using a chloride bath, or the surface of the zinc-based plated film formed using a zincate bath without baking treatment, the carboxylic acid compound may include at least one from citric acid compound and oxalic acid compound, or may preferably consist essentially of citric acid compound or oxalic acid compound. When the metal-based surface is the surface of the zinc-based plated film formed using a chloride bath with the baking treatment, the carboxylic acid compound may preferably include oxalic acid compound, or may more preferably consist essentially of oxalic acid compound.

5. Use of Chemical Conversion Coating

Descriptions will be directed to the usage of chemical conversion treatment liquid of the present embodiment.

The use of the chemical conversion coating of the present embodiment includes contacting the acidic composition according to the present embodiment to a base material having metal-based surface to form the chemical conversion coating on the metal-based surface of the base material. The relation between the metal-based surface of the base material being the treatment surface and the carboxylic acid composition are the same in the production method of the member having the chemical conversion coating on its surface, therefore descriptions on the relation will be omitted.

It is to be noted that the embodiments as heretofore explained are described to facilitate understanding of the present invention and are not described to limit the present invention. Therefore, it is intended that the elements disclosed in the above embodiments include all design changes and equivalents to fall within the technical scope of the present invention.

EXAMPLES

Advantageous effects of one or more embodiments of the present invention will hereinafter be described with reference to Examples, but the present invention is not limited thereto.

Example 1

1. Preparation of Test Members

Chemical conversion treatment liquids were prepared to have a basic composition shown in Table 1 and respective detailed compositions shown in Table 2. The chemical conversion treatment liquid 1-25 was such that the compounding amount in terms of titanium of the water-soluble titanium compound was 0.001 mol/L, and the compounding amount in terms of aluminum of the water-soluble aluminum compound was 0.001 mol/L.

TABLE 1

| Compounding component | Content at bath preparation |
|---|---|
| Chromium nitrate | 42 mmol/L in terms of Cr |
| Zinc chloride | 15 mmol/L in terms of Zn |
| Source of carboxylic acid, etc. | 8 mmol/L in terms of carboxylic acid |
| Organic phosphonic acid compound | 0.01 mol/L in terms of P |
| Water-soluble additive metal compound | 0.001 mol/L in terms of metal |

In Table 1, the "source of carboxylic acid, etc." collectively means a carboxylic acid source and a water-soluble compound that is able to generate an organic acid compound in water. The "water-soluble additive metal compound" means those other than the water-soluble trivalent chromium compound and the water-soluble zinc compound among water-soluble metal compounds to involve water-soluble metal-containing substance in the chemical conversion treatment liquid. The organic phosphonic acid compound was "DEQUEST 2010" available from Thermphos Japan Ltd.

TABLE 2

| Chemical conversion treatment liquid | Source of carboxylic acid, etc. | Additive metal | White rust area ratio (%) after SST 96 h | Dissolving amount (μg/cm²) Chromium | Dissolving amount (μg/cm²) Additive metal | Appearance Color tone | Appearance Gloss and uniformity |
|---|---|---|---|---|---|---|---|
| 1-1 | Citric acid | None | 5 | 0.06 | 0 | Blue to white | A |
| 1-2 | | Co | 4 | 0.1 | 0.072 | Blue to yellow | A |
| 1-3 | | Ni | 15 | 0 | 0.02 | Blue to yellow | A |
| 1-4 | | Ti | 1 | 0.03 | 0.08 | Blue to yellow | B |
| 1-5 | | V | 2 | 0.07 | 0.52 | Yellow | C |
| 1-6 | | Al | 25 | 0 | 0.071 | White to yellow | C |
| 1-7 | Oxalic acid | None | 6 | 0.09 | 0 | Blue | A |
| 1-8 | | Co | 0 | 0.1 | 0.09 | Blue to white | A |
| 1-9 | | Ni | 8 | 0 | 0 | Blue | A |
| 1-10 | | Ti | 1 | 0.02 | 0.105 | Yellow | C |
| 1-11 | | V | 2 | 0 | 0.8 | Yellow | C |
| 1-12 | | Al | 5 | 0 | 0.11 | Blue | B |
| 1-13 | Malic acid | None | 60 | 0 | 0 | Blue to white | A |
| 1-14 | | Co | 4 | 0.05 | 0.05 | Blue to white | A |
| 1-15 | | Ni | 13 | 0 | 0 | Blue to white | A |
| 1-16 | | Ti | 5 | 0 | 0.1 | White to yellow | C |
| 1-17 | | V | 3 | 0 | 0.9 | Yellow | C |
| 1-18 | | Al | 15 | 0 | 0.18 | Blue to white | B |
| 1-19 | Lactic acid | None | 50 | 0 | 0.06 | White to yellow | B |
| 1-20 | | Co | 10 | 0.02 | 0 | White to yellow | B |
| 1-21 | | Ni | 60 | 0 | 0 | Yellow | C |
| 1-22 | | Ti | 3 | 0.07 | 0 | White to red | D |
| 1-23 | | V | 4 | 0 | 0.8 | Yellow | C |
| 1-24 | | Al | 12 | 0 | 0.07 | Blue to white | B |
| 1-25 | Oxalic acid | Ti/Al | 1 | 0.03 | 0.09/0.01 | Blue to white | B |

The "additive metal" in Table 2 means a metal that is associated with the water-soluble additive metal compound in Table 1. The type of water-soluble metal compound associated with each metal was as follows:

Co: cobalt nitrate;

Ni: nickel chloride;

Ti: titanyl sulfate;

V: sodium vanadate; and

Al: aluminum nitrate.

Zinc plating treatment was performed under the condition below for base materials including steel M10 bolts, and each base material was thus obtained to have a zinc plated film on the surface:

zinc plating composition: chloride bath (ammonium-potassium mixed bath);

plating temperature: 30° C.;

plating time: 1,800 seconds; and electrolytic condition: 1.5 A/dm$^2$.

Rinsing was performed for the base materials after the zinc plating treatment by immersing the base materials in pure water of 23° C. for 10 seconds while swinging them. Activation treatment was then performed for the base materials after the zinc plating treatment and rinsing, by immersing the base materials in diluted nitric acid aqueous solution (3 ml/L) of 23° C. for 10 seconds while swinging them. Rinsing was performed again for the base materials put out from the diluted nitric acid aqueous solution by immersing the base materials in pure water of 23° C. for 10 seconds while swinging them.

Chemical conversion treatment was performed for each base material after the activation treatment and rinsing, by immersing the base material in either one of the above chemical conversion treatment liquids 1-1 to 1-25, maintained at 30° C., for 45 seconds while swinging the base material. Rinsing was then performed for the base material put out from the chemical conversion treatment liquid by immersing the base material in pure water of 23° C. for 10 seconds while swinging the base material. The base material after the chemical conversion treatment and rinsing was dried by being stationarily placed for 10 minutes in an oven maintained at 80° C. A member having its surface formed thereon with the chemical conversion coating was thus obtained as each of test members 1-1 to 1-25.

2. Evaluations of Test Members (1) Evaluation of Corrosion Resistance

For the obtained test members 1-1 to 1-25, the neutral salt spray test in conformity with JIS Z2371: 2000 (ISO 9227: 1990) was conducted for 96 hours, followed by visual observation of the surface of each test member after the test to measure a white rust generating area, and the white rust area ratio (unit: %) was obtained by measuring the ratio of the white generating area to the area of the main surface of the test member.

(2) Measurement of Dissolving Amount

One test member (surface area: 25 cm$^2$) was immersed in 100 ml of pure water for 24 hours. The test member was then put out therefrom, and the metal amount dissolved into water was measured using an ICP (SPS 5520 available from SII NanoTechnology Inc.) to obtain the dissolving amount (unit: μg/cm$^2$).

(3) Appearance (3-1) Color Tone

The surface formed of the chemical conversion coating of each test member was visually observed, and the color tone was evaluated.

(3-2) Gloss and Uniformity

The surface of each test member was visually observed, and the gloss and the uniformity in appearance were evaluated in accordance with the criteria below:

A (excellent): gloss present, no tarnish found, and uniform appearance over the entire surface;

B (good): little tarnish found and/or gloss slightly weak;

C (acceptable): tarnish present, gloss weak, and/or appearance uniformity slightly low; and D (defective): tarnish strong, no gloss, and/or appearance non-uniform.

3. Results

Evaluation results are listed in Table 2. As shown in Table 2, upon the chemical conversion treatment liquids each containing a water-soluble titanium-containing substance and a carboxylic acid compound (chemical conversion treatment liquids 1-4, 1-10, 1-16 and 1-22), the chemical conversion coatings formed using such chemical conversion treatment liquids (the present chemical conversion coatings) had excellent corrosion resistance comparable with or higher than those of the chemical conversion coatings formed using the chemical conversion treatment liquids each containing the water soluble cobalt-containing substance (Co-containing chemical conversion coatings). In addition, the dissolving amount of metal each from the present chemical conversion coatings was comparable with those from the Co-containing chemical conversion coatings, thus presenting low possibility of affecting the environment in view of the metal dissolution from the chemical conversion coating.

In contrast, upon the chemical conversion treatment liquids each containing the water-soluble metal-containing substance associated with Ni or Al, the obtained chemical conversion coatings had far poorer corrosion resistance than those of the Co-containing chemical conversion coatings. Upon the chemical conversion treatment liquids each containing the water-soluble metal-containing substance associated with V, the dissolving amount of metal was unduly large, thus presenting high possibility of affecting the environment in view of the metal dissolution from the chemical conversion coating.

Example 2

Chemical conversion treatment liquids 2-1 to 2-13 were obtained with the compositions listed in Table 1 by excluding water-soluble additive metal compound and changing the content of citric acids as the source of carboxylic acid, etc. to have the ratio values listed in Table 3. This ratio also refers hereinafter to "CA1/Cr ratio", which is a ratio of the content of citric acid compound in terms of citric acid (unit: mol/L) to the content of water-soluble trivalent chromium-containing substance in terms of chromium (unit: mol/L). Chemical conversion treatment liquids 2-14 to 2-27 were obtained with the compositions listed in Table 1 by excluding water-soluble additive metal compound and changing the content of oxalic acids as the source of carboxylic acid, etc. to have the ratio values listed in Table 3. This ratio also refers hereinafter to "CA2/Cr ratio", which is a ratio of the content of oxalic acid compound in terms of oxalic acid (unit: mol/L) to the content of water-soluble trivalent chromium-containing substance in terms of chromium (unit: mol/L).

TABLE 3

| Chemical conversion treatment liquid | Source of Carboxylic acid, etc. | CA1/Cr ratio | Appearance (gloss, uniformity) | White rust area ratio (%) 48 h | 72 h | 96 h |
|---|---|---|---|---|---|---|
| 2-1 | Citric Acid | 0 | C | 12 | 25 | 50 |
| 2-2 | | 0.1 | A | 1 | 15 | 25 |
| 2-3 | | 0.2 | A | 3 | 5 | 5 |
| 2-4 | | 0.4 | A | 0 | 2 | 7 |
| 2-5 | | 0.6 | B | 5 | 7 | 10 |
| 2-6 | | 0.8 | B | 3 | 15 | 17 |
| 2-7 | | 1 | C | 1 | 15 | 25 |
| 2-8 | | 1.2 | C | 3 | 25 | 35 |
| 2-9 | | 1.5 | C | 45 | 55 | 60 |
| 2-10 | | 1.7 | C | 30 | 60 | 80 |
| 2-11 | | 2 | C | 40 | 60 | 80 |
| 2-12 | | 2.3 | D | 50 | 80 | 90 |
| 2-13 | | 2.5 | D | 50 | 80 | 90 |

| Chemical conversion treatment liquid | Source of Carboxylic acid, etc. | CA2/Cr ratio | Appearance (gloss, uniformity) | White rust area ratio (%) 48 h | 72 h | 96 h |
|---|---|---|---|---|---|---|
| 2-1 | Oxalic Acid | 0 | C | 12 | 25 | 50 |
| 2-14 | | 0.1 | A | 1 | 7 | 12 |
| 2-15 | | 0.2 | A | 0 | 4 | 8 |
| 2-16 | | 0.4 | A | 0 | 4 | 10 |
| 2-17 | | 0.6 | A | 0 | 1 | 3 |
| 2-18 | | 0.8 | A | 0 | 2 | 5 |
| 2-19 | | 1 | A | 0 | 0 | 1 |
| 2-20 | | 1.2 | A | 0 | 0 | 1 |
| 2-21 | | 1.3 | A | 0 | 1 | 3 |
| 2-22 | | 1.4 | A | 0 | 1 | 2 |
| 2-23 | | 1.5 | A | 0 | 0 | 2 |
| 2-24 | | 1.7 | A | 0 | 2 | 3 |
| 2-25 | | 2 | A | 0 | 2 | 6 |
| 2-26 | | 2.3 | A | 0 | 4 | 10 |
| 2-27 | | 2.5 | A | 0 | 3 | 10 |

Test members 2-1 to 2-27 corresponding to the chemical conversion treatment liquids 2-1 to 2-27 were obtained in the same manner in Example 1.

For the obtained test members 2-1 to 2-27, the neutral salt spray test in conformity with JIS Z2371: 2000 (ISO 9227: 1990) was conducted, followed by visual observation of the surface of each test member after the test of 48 hours, 72 hours, and 96 hours, to obtain the white rust area ratio (unit: %) at each timing.

As a result, the white rust area ratio was confirmed to vary by changing the CA1/Cr ratio or CA2/Cr ratio as shown in Table 2.

Example 3

As shown in Table 4, test members 3-1 to 3-15 were prepared by using the chemical conversion treatment liquids prepared in Example 1 and performing the same operations as those in Example 1.

TABLE 4

| Test member | Chemical conversion treatment liquid | Source of carboxylic acid, etc. | Additive metal | White rust area ratio (%) 72 h | 120 h | 168 h | 216 h | Dissolving amount ($\mu g/cm^2$) chromium | Additive metal |
|---|---|---|---|---|---|---|---|---|---|
| 3-1 | 1-1 | Citric acid | None | 2 | 5 | 15 | 30 | 0.05 | — |
| 3-2 | 1-2 | | Co | 0 | 1 | 3 | 5 | 0.04 | 0.02 |
| 3-3 | 1-4 | | Ti | 0 | 1 | 2 | 5 | 0.03 | 0.08 |
| 3-4 | 1-5 | | V | 0 | 1 | 1 | 3 | 0.03 | 0.34 |
| 3-5 | 1-6 | | Al | 10 | 25 | 30 | 40 | 0.02 | <0.01 |
| 3-6 | 1-7 | Oxalic acid | None | 2 | 3 | 8 | 11 | 0.02 | — |
| 3-7 | 1-8 | | Co | 1 | 2 | 3 | 4 | 0.04 | 0.02 |
| 3-8 | 1-10 | | Ti | 1 | 2 | 4 | 9 | 0.02 | 0.08 |
| 3-9 | 1-11 | | V | 0.5 | 1 | 2 | 2 | 0.03 | 0.28 |
| 3-10 | 1-12 | | Al | 10 | 18 | 30 | 45 | 0.01 | <0.01 |
| 3-11 | 1-19 | Lactic acid | None | 5 | 15 | 20 | 18 | 0.02 | — |
| 3-12 | 1-20 | | Co | 5 | 10 | 12 | 15 | 0.02 | <0.01 |
| 3-13 | 1-22 | | Ti | 2 | 3 | 7 | 10 | 0.05 | 0.08 |

TABLE 4-continued

| Test member | Chemical conversion treatment liquid | Source of carboxylic acid, etc. | Additive metal | White rust area ratio (%) 72 h | 120 h | 168 h | 216 h | Dissolving amount (μg/cm²) chromium | Additive metal |
|---|---|---|---|---|---|---|---|---|---|
| 3-14 | 1-23 | | V | 1 | 2 | 3 | 6 | 0.03 | 0.21 |
| 3-15 | 1-24 | | Al | 10 | 15 | 25 | 35 | 0.01 | <0.01 |

An Auto-gilder was used, into which 1 kg of steel M10 bolts as dummies and each 1 kg of the test members 3-1 to 3-15 were put to be rotated for 2 minutes, thereby scratching each test member, and a state was obtained where metal dissolution was likely to occur.

For these test members, the neutral salt spray test in conformity with JIS Z2371: 2000 (ISO 9227: 1990) was conducted, followed by visual observation of the surface of each test member after the test of 72 hours, 120 hours, 168 hours, and 216 hours, to obtain the white rust area ratio (unit: %) at each timing.

One test member (surface area: 25 $cm^2$) was immersed in 100 ml of pure water for 24 hours. The test member was then put out therefrom, and the metal amount dissolved into water was measured using an ICP (SK-150 available from Shinkyoritsu Kako Co., Ltd.) to obtain the dissolving amount (unit: $\mu g/cm^2$).

As a result, the test members 3-3, 3-8 and 3-13 obtained using the chemical conversion treatment liquids 1-4, 1-10 and 1-22 each containing the water-soluble titanium-containing substance had excellent corrosion resistance and metal dissolving amount comparable with or more than those of the test members (3-2, 3-7 and 3-12) obtained using the chemical conversion treatment liquids (1-2, 1-8 and 1-20) each containing the water-soluble cobalt-containing substance. In contrast, upon the chemical conversion treatment liquids each containing the water-soluble metal-containing substance other than the water-soluble titanium-containing substance, the result was such that at least one of the corrosion resistance and metal dissolving amount of each obtained chemical conversion coating was far poorer than those of the test members obtained using the chemical conversion treatment liquids each containing the water-soluble cobalt-containing substance.

Example 4

Chemical conversion treatment liquid 4 was prepared by excluding the zinc oxide as the water-soluble zinc compound and the organic phosphonic acid compound from the chemical conversion treatment liquid 1-4 prepared in Example 1.

Two types of test members were produced by using these chemical conversion treatment liquid 4 and chemical conversion treatment liquid 1-4 and performing the same operations as those in Example 1. For these test members, the same neutral salt spray test as that for Example 1 and the same neutral salt spray test after scratching as that for Example 3 were conducted, and each white rust area ratio (unit: %) was measured after the test of 72 hours and 120 hours. In addition, for these test members, measurement of the dissolving amount of metal was performed like in Example 1. These results are listed in Table 5.

TABLE 5

| Chemical conversion treatment liquid | White rust area ratio (%) Without scratching 72 h | Without scratching 120 h | With scratching 72 h | With scratching 120 h | Dissolving amount (μg/cm²) Chromium | Additive metal |
|---|---|---|---|---|---|---|
| 4 | 0 | 3 | 1 | 5 | 0.07 | 0.08 |
| 1-4 | 0 | 1 | 1 | 4 | 0.03 | 0.08 |

Example 5

Chemical conversion treatment liquids 5-1 to 5-8 were obtained with the compositions listed in Table 1 by adding 0.001 mol/L of water-soluble titanium compound in terms of titanium as the water-soluble additive metal compound and changing the content of citric acid or oxalic acid to have respective CA1/Cr ratio or CA2/Cr ratio values listed in Table 6. Test members 5-1 to 5-8 corresponding to the chemical conversion treatment liquids 5-1 to 5-8 were obtained in the same manner in Example 1.

The surface of each of obtained test members 5-1 to 5-8 was visually observed, then the gloss and the uniformity in appearance were evaluated in accordance with the criteria in Example 1 (A to D). For the obtained test members 5-1 to 5-8, the neutral salt spray test in conformity with JIS Z2371: 2000 (ISO 9227: 1990) was conducted, followed by visual observation of the surface of each test member after the test of 48 hours, 72 hours, and 96 hours, to obtain the white rust area ratio (unit: %) at each timing.

As a result, showing in Table 6, it was observed that the white rust area ratio was variable by changing CA1/Cr ratio or CA2/Cr ratio.

TABLE 6

| Chemical conversion treatment liquid | Source of Carboxylic acid, etc. | CA1/Cr ratio | Appearance (gloss, uniformity) | White rust area ratio (%) 48 h | 72 h | 96 h |
|---|---|---|---|---|---|---|
| 5-1 | Citric Acid | 0.1 | B | 0 | 1 | 5 |
| 5-2 | | 0.2 | A | 0 | 0 | 1 |

TABLE 6-continued

| | | | | | | |
|---|---|---|---|---|---|---|
| 5-3 | | 0.6 | B | 1 | 3 | 6 |
| 5-4 | | 1 | B | 2 | 10 | 15 |

| Chemical conversion treatment liquid | Source of Carboxylic acid, etc. | CA2/Cr ratio | Appearance (gloss, uniformity) | White rust area ratio (%) 48 h | 72 h | 96 h |
|---|---|---|---|---|---|---|
| 5-5 | Oxalic Acid | 0.2 | C | 0 | 1 | 1 |
| 5-6 | | 0.6 | C | 0 | 0 | 1 |
| 5-7 | | 1.4 | A | 0 | 0 | 0 |
| 5-8 | | 2 | B | 0 | 1 | 2 |

Example 6

Chemical conversion treatment liquids 6-1 to 6-10 were obtained with the compositions listed in Table 1 except using, as water-soluble additive metal compound, two kinds of water-soluble additive metals from water-soluble titanium compound, water-soluble aluminum compound, water-soluble vanadium compound, and water-soluble nickel compound as listed in Table 7. The content of the water-soluble additive metal was 0.001 mol/L in terms of metal in each compound and the content of citric acid or oxalic acid was adjusted to have respective CA1/Cr ratio or CA2/Cr ratio values listed in Table 7. Test members 6-1 to 6-10 corresponding to the chemical conversion treatment liquids 6-1 to 6-10 were obtained in the same manner in Example 1.

The surface of each of obtained test members 6-1 to 6-10 was visually observed, then the gloss and the uniformity in appearance were evaluated in accordance with the criteria in Example 1 (A to D). For the obtained test members 6-1 to 6-10, the neutral salt spray test in conformity with JIS Z2371: 2000 (ISO 9227: 1990) was conducted, followed by visual observation of the surface of each test member after the test of 48 hours, 72 hours, and 96 hours, to obtain the white rust area ratio (unit: %) at each timing. The results are shown in Table 7.

TABLE 7

| Chemical conversion treatment liquid | Source of Carboxylic acid, etc. | CA1/Cr ratio | Additive metal 1 | Additive metal 2 | Appearance (gloss, uniformity) | White rust area ratio (%) 48 h | 72 h | 96 h |
|---|---|---|---|---|---|---|---|---|
| 6-1 | Citric Acid | 0.2 | Ti | Al | A | 0 | 0 | 0 |
| 6-2 | | | | V | C | 0 | 0 | 1 |
| 6-3 | | | | Ni | B | 0 | 2 | 3 |
| 6-4 | | | Al | V | C | 0 | 1 | 3 |
| 6-5 | | | | Ni | B | 0 | 2 | 3 |

| Chemical conversion treatment liquid | Source of Carboxylic acid, etc. | CA2/Cr ratio | Additive metal 1 | Additive metal 2 | Appearance (gloss, uniformity) | White rust area ratio (%) 48 h | 72 h | 96 h |
|---|---|---|---|---|---|---|---|---|
| 6-6 | Oxalic Acid | 1.4 | Ti | Al | A | 0 | 0 | 0 |
| 6-7 | | | | V | C | 0 | 0 | 1 |
| 6-8 | | | | Ni | B | 0 | 0 | 1 |
| 6-9 | | | Al | V | C | 0 | 2 | 4 |
| 6-10 | | | | Ni | A | 0 | 3 | 5 |

What is claimed is:

1. A reactive-type chemical conversion treating acidic composition comprising a water-soluble trivalent chromium-containing substance, a water-soluble titanium-containing substance, and carboxylic acid compounds, the acidic composition being free from a water-soluble cobalt-containing substance, wherein the carboxylic acid compounds comprise citric acid compounds and oxalic acid compounds;

wherein first ratio, which is ratio of the content of citric acid compounds in terms of citric acid (unit: mol/L) to the content of water-soluble trivalent chromium-containing substance in terms of chromium (unit: mol/L) is 0.1 or more and 0.8 or less; and wherein second ratio, which is ratio of the content of oxalic acid compounds in terms of oxalic acid (unit: mol/L) to the content of water-soluble trivalent chromium-containing substance in terms of chromium (unit: mol/L) is 0.6 or more and 1.7 or less.

2. The reactive-type chemical conversion treating acidic composition according to claim 1, wherein the content of the water-soluble trivalent chromium-containing substance in the composition is 0.01 mol/L or more and 0.15 mol/L: or less in terms of chromium, the content of the water-soluble titanium-containing substance in the composition is 0.0001 mol/L or more and 1 mol/L or less in terms of titanium, and the content of the carboxylic acid compound in the composition is 0.001 mol/L or more and 0.2 mol/L or less in terms of carboxylic acid.

3. The reactive-type chemical conversion treating acidic composition according to claim 1, wherein the composition is free from water-soluble vanadium-containing substance, water-soluble fluorine-containing substance, or film-forming organic component.

4. The reactive-type chemical conversion treating acidic composition according to claim 1, further comprising organic phosphoric acid compound of 0.001 mol/L or more and 1 mol/L or less in terms of phosphorus.

5. The reactive-type chemical conversion treating acidic composition according to claim 4, further comprising water-soluble zinc-containing substance of 0.005 mol/L or more and 0.1 mol/L or less in terms of zinc.

6. The reactive-type chemical conversion treating acidic composition according to claim 1, further comprising water-soluble aluminum-containing substance of 0.0001 mol/L or more and 0.1 mol/L or less in terms of aluminum.

7. A production method of a member having a surface provided thereon with a chemical conversion coating, the production method comprising:

a contacting step that causes a reactive-type chemical conversion treating acidic composition to contact with a base material having a metal-based surface thereby forming a chemical conversion coating on the metal-based surface of the base material; and a washing step that washes the base material having been subjected to the contacting step to obtain a member having a surface provided thereon with the chemical conversion coating, wherein the reactive-type chemical conversion treating acidic composition comprises a water-soluble trivalent chromium-containing substance, a water-soluble titanium-containing substance, and carboxylic acid compounds, the acidic composition being free from a water-soluble cobalt-containing substance;

wherein the carboxylic acid compounds comprise citric acid compounds and oxalic acid compounds;

wherein first ratio, which is ratio of the content of citric acid compounds in terms of citric acid (unit: mol/L) to the content of water-soluble trivalent chromium-containing substance in terms of chromium (unit: mol/L) is 0.1 or more and 0.8 or less; and wherein second ratio, which is ratio of the content of oxalic acid compounds in terms of oxalic acid (unit: mol/L) to the content of water-soluble trivalent chromium-containing substance in terms of chromium (unit: mol/L) is 0.6 or more and 1.7 or less.

8. The production method of a member according to claim 7, wherein the metal-based surface is either one surface selected from the group consisting of a surface of the zinc-based plated film formed using a chloride bath, a surface of the plated film obtainable by forming a zinc-based plated film using a zincate bath and subjecting this to baking treatment, and a surface of the zinc-based plated film formed using a zincate bath without baking treatment.

9. The production method of a member according to claim 8, wherein the metal-based surface is the surface of the zinc-based plated film formed using a zincate bath without baking treatment, and the carboxylic acid compound includes oxalic acid compound.

* * * * *